United States Patent [19]

Szabo

[11] 4,343,104

[45] Aug. 10, 1982

[54] DISPLAY OF ARTICLES

[76] Inventor: Andrea Szabo, 1626 Wentwood Dr., Pasadena, Tex. 77504

[21] Appl. No.: 285,796

[22] Filed: Jul. 22, 1981

[51] Int. Cl.[3] ..... G09F 3/18

[52] U.S. Cl. ..... 40/10 R; 40/152; 63/19

[58] Field of Search ..... 63/18, 19; 40/10, 152, 40/156

[56] References Cited

U.S. PATENT DOCUMENTS

| | | | |
|---|---|---|---|
| 2,190,273 | 2/1940 | Shapiro | 40/152 |
| 2,220,038 | 10/1940 | Kreisler et al. | 40/152 |
| 2,769,249 | 11/1956 | Illes | 63/19 |
| 3,618,338 | 11/1971 | Sauer | 63/19 |
| 3,624,939 | 12/1971 | Gossard | 63/152 |
| 4,063,378 | 12/1977 | Burke | 40/156 |

*Primary Examiner*—Gene Mancene
*Assistant Examiner*—Wenceslao J. Contreras
*Attorney, Agent, or Firm*—Vaden, Eickenroht, Thompson, Bednar & Jamison

[57] ABSTRACT

An ornamental design for display of selected articles such as photographs. This design has a bifurcated body with base members connected by a hinge. A recess in the body is formed by overlaying edges on these members. A filigree cover is integrally carried by one member, but it is releasably secured to the other member. As a result, the cover is released and the members fold rearwardly to permit the article to be displayed, to be inserted or to be removed from the recess.

9 Claims, 6 Drawing Figures

Fig. 1
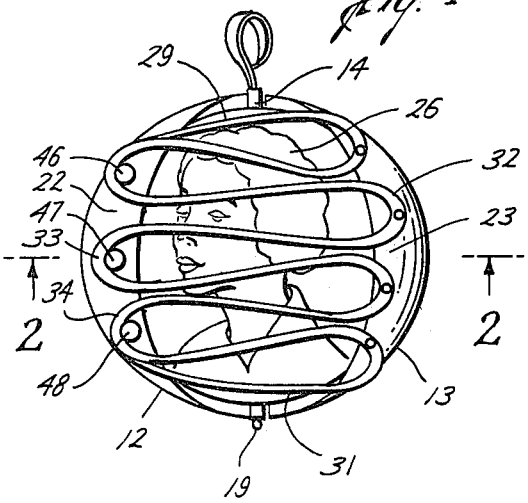
Fig. 2
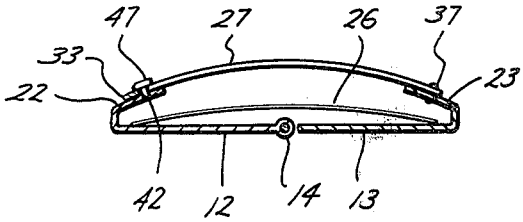
Fig. 3
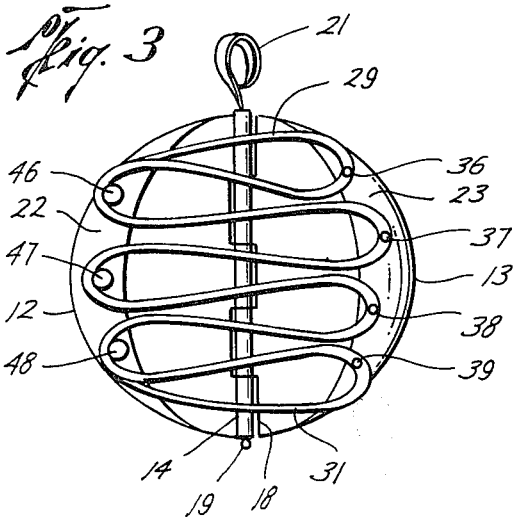
Fig. 4
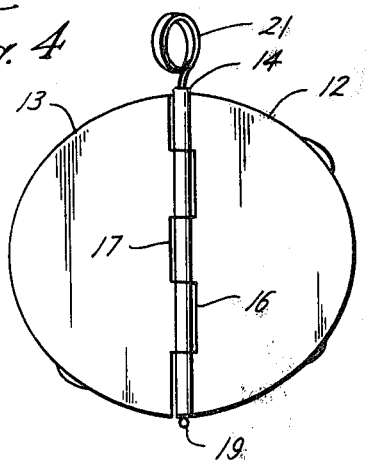
Fig. 5
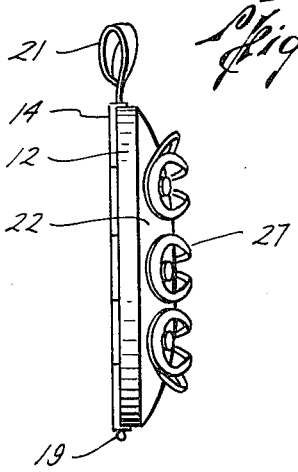
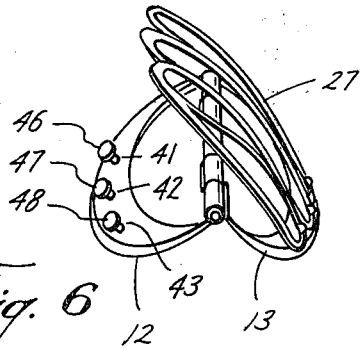
Fig. 6

DISPLAY OF ARTICLES

BACKGROUND OF THE INVENTION

1. Field of the Invention

This invention is related to jewelry, and more particularly, it concerns a holder to display photographs or the like.

2. Background of the Invention

Many pieces of jewelry have been made for the display of selected articles such as photographs. The flat locket with transparent cover is one example of the prior art. Other holders have been proposed for other articles such as lockets of hair, pressed flowers and similar things. Usually, the holder for a photograph does not safely allow viewing of both flat and three dimensional articles.

In addition, the holders having capacity for various articles usually had loose parts that could be dropped, broken or otherwise lost, which rendered the holder defective.

The present design provides for the display with equal facility of flat articles like photographs, as well as three dimensional articles like flowers. Of great advantage, this design has several co-functioning parts, but none can be lost during use. In addition, these parts provide ornamental function besides their contribution to the utility of the design.

SUMMARY OF THE INVENTION

In accordance with this invention, there is provided an ornamental design for display of selected articles such as photographs or flowers. This design has a bifurcated body formed by a hinged pair of flat base members. Overlaying edges on these members form a recess to accommodate the article to be displayed. The recess is enclosed by a filigree cover extending from edge to edge on the members. The cover is integrally carried by one member, but it is releasably secured to the overlaying edge of the other member. Release of the cover from one member allows access to the recess by folding rearwardly the members. Then, the article to be displayed can be inserted or removed as desired.

DESCRIPTION OF THE DRAWINGS

FIG. 1 is an elevation showing one embodiment of the present design with a photograph being displayed;

FIG. 2 is a cross-section taken along line 2—2 of the design shown in FIG. 1;

FIG. 3 is an elevation of the design with the displayed article having been removed;

FIG. 4 is a rear elevation of the design shown in FIG. 3;

FIG. 5 is a side view of the design shown in FIG. 3; and

FIG. 6 is an oblique perspective of the design of FIG. 3, but with the cover released and members folded rearwardly for access to the recess therein.

DESCRIPTION OF EMBODIMENT

Referring to FIGS. 1–6, there is shown an ornamental design constructed in accordance with one embodiment of this invention. The design 11 can be constructed of any suitable material, but preferably it is formed from thin sheets of rare metals, such as silver. The design 11 has a bifurcated body provided by a pair of planar base members 12 and 13.

The members are pivotally interconnected by a hinge 14 as best seen in FIG. 4. The hinge 14 can be formed by any system of hooks and pins, but good results are obtained by using interlaced straps 16 and 17 which are bent into a circular pattern forming a longitudinally aligned round opening 18.

A pin 19 is passed through the opening 18 and produces the hinge 14 to interconnect pivotally the members 12 and 13. The pin 19 may carry a loop 21 at one end to receive a cord or other support for carrying the design 11 on the user's body. The end of the pin 19 remote from the loop 21 is provided with a stop or enlargement 22 so that the pin cannot be inadvertently withdrawn from the straps 16 and 17.

The members 12 and 13 have overlaying edges 22 and 23, respectively, which form a recess 24 within the design 11. These edges may be formed by rolling the metal of the members in a reverse direction about them, and also in a spaced relationship to them.

As seen in FIG. 2, the recess 24 is dimensioned of a selected relationship to accomodate the article to be displayed. For example, the recess may have a planar area of 25 by 30 mm and a depth of 2–3 mm. As a result, a photograph 26 may snugly reside in the recess.

The members 12 and 13 can have any configuration desired, but preferably these members are mirror images of each other across the hinge 14. This spatial arrangement is not only attractive to view but provides a near circumferential boundary by the edges 22 and 23 to the recess 24.

The recess 24 is enclosed topwise by a filigree cover 27 which is adapted to secure the display and provide an attractive view screen or matt type of visual emphasis accentuator system.

More particularly, the cover 27 is preferably formed by a winding ribbon 28 which is sensuous and formed into loops. The terminal loops 29 and 31 are completed with the intermediate loops 32–34 interlaced therebetween. However, these intermediate loops may be integrally connected at their exterior parts by soldering or the like to provide additional rigidity or for other reasons.

In reference especially to FIGS. 2, 3 and 5, the loops are secured integrally to the member 13 and rivets 36–39 can provide this function. These rivets traverse the adjacent loops of the cover 27 and pass through the overlaying edge 23. The rivets are provided with the usual head and flattened end to secure these parts together.

The loops remote from the rivets are releaseably secured to member 12 in a convenient manner. For example, snap closure fasteners can be used for this purpose. These fasteners can be provided by enlarged headed posts 41–43 which extend exteriorly from their integral mounting on the overlaying edge 22 of the member 12. The enlarged head parts 46–48 of these posts pass through the open areas at the end of the encountered loops 32–34. In addition, there is a slight tension fit between the head parts and the loops so that the cover 27 must be press fitted into secured position. As a result, these head parts snap over the ribbon forming these loops as best seen in FIG. 5.

This mechanism for snap action securing of the cover 27 to the member 12 insures that inadvertent opening of the design cannot occur. Yet, the cover 27 is readily opened by slight pressure on the cover 27 above the hinge 14 with lifting of the loops from about the headed pins.

The cover 27 gives best results when the loops are convex in shape relative to the planar members 12 and 13. This arched configuration in the loops as seen in FIG. 6 provides for more ready insertion of larger display articles such as flowers. In addition, the curved loops slide gently over the display when the cover 27 is snap fastened into place on the headed pins.

Although the cover 27 can be formed of other open types of filigree structures, the loop configuration provides a curved complement both visually and structurally to the rounded contures of the overlaying edges 22 and 23.

From the foregoing, it will be apparent that there has been described an ornamental display having structure well arranged for the safe and attractive display of various articles. Many changes can be made to the specified embodiment of this design which fall within the spirit of this invention. It is however intended that the appended claims define the scope of this invention.

What is claimed is:

1. An ornamental design for display of selected articles such as photographs comprising:

(a) a bifurcated body having a pair of planar base members and hinge means connecting said members together for a pivotal interconnection therebetween;

(b) said members having overlaying edges forming a recess adapted to secure an article to be displayed;

(c) a filigree cover extending across said recess from edge to edge on said base members;

(d) said cover integrally carried by one of said members at said overlaying edge thereon; and (e) said cover releasably secured to the other of said base members at said overlaying edge thereon, whereby said cover is released from said overlaying edge and said base members pivoted rearwardly from said cover to permit the article to be displayed, to be inserted or removed from the recess in said members.

2. The ornamental design of claim 1 wherein said filigree cover has return loops adjacent one of said base members at said overlaying edge and snap closing fastener means engage said loops to releasably secure said filigree cover to said overlaying edge.

3. The ornamental design of claim 2 wherein said fastener means comprises a post projecting from said overlaying edge, and said post has an enlarged head to releasably secure said cover to said member.

4. The ornamental design of claim 1 wherein said hinge means comprises interlaced hooks carried by said members and a pin extending axially through said hooks to pivotally mounts said members into interconnection, and said pin formed into a loop at one end as a mount to receive a cord.

5. The ornamental design of claim 1 wherein said members are mirror images of each other across said hinge means thereby forming a symmetrical bifurcated body.

6. The ornamental design of claim 1 wherein said filigree cover is formed by a plurality of loops extending transversely across said hinge means.

7. The ornamental design of claim 6 wherein said loops are formed from a continuous metallic ribbon and its ends are returned into the ribbon to complete the terminal loops forming said filigree cover.

8. The ornamental design of claim 1 wherein said cover is convex in configuration relative to said members whereby insertion or removal of display articles is facilitated.

9. The ornamental design of claim 8 wherein said cover is resilient and depressing same above said hinge means allows ready release of said cover from said overlaying edge of said member.

* * * * *